US011399635B2

(12) United States Patent
Yang

(10) Patent No.: US 11,399,635 B2
(45) Date of Patent: Aug. 2, 2022

(54) SLEEPING SYSTEM

(71) Applicant: Li Yang, Changzhou (CN)

(72) Inventor: Li Yang, Changzhou (CN)

( * ) Notice: Subject to any disclaimer, the term of this patent is extended or adjusted under 35 U.S.C. 154(b) by 0 days.

(21) Appl. No.: 16/942,377

(22) Filed: Jul. 29, 2020

(65) Prior Publication Data

US 2021/0059424 A1 Mar. 4, 2021

(51) Int. Cl.
*A47C 27/07* (2006.01)
*A47C 27/06* (2006.01)

(52) U.S. Cl.
CPC ..... *A47C 27/062* (2013.01); *A47C 27/064* (2013.01); *A47C 27/07* (2013.01)

(58) Field of Classification Search
CPC ..... A47C 27/06; A47C 27/062; A47C 27/063; A47C 27/064; A47C 27/07
See application file for complete search history.

(56) References Cited

U.S. PATENT DOCUMENTS 6,397,418 B1 * 6/2002 Stjerna ..... A47C 27/062 5/720
7,992,242 B2 * 8/2011 Antinori ..... A47C 23/0522 5/727
2005/0273939 A1 * 12/2005 Mossbeck ..... A47C 27/088 5/720

FOREIGN PATENT DOCUMENTS

WO WO-2016148661 A1 * 9/2016 ..... A47C 27/00

* cited by examiner

*Primary Examiner* — Fredrick C Conley

(57) ABSTRACT

A sleeping system includes a comfortable layer comprising a plurality of pressure relief springs and a supporting layer arranged under the comfortable layer. The supporting layer includes a plurality of supporting springs corresponding to the plurality of pressure relief springs, each of the plurality of supporting springs is connected with one of the plurality of pressure relief springs to constitute a pair of spring, the supporting springs and the supporting springs forms a plurality of pairs of springs arranged along a length direction and a width direction, each pair of spring has a same size, and a ratio of a length of the supporting spring to a length of the pressure relief spring varies smoothly along the length direction of the sleeping system.

18 Claims, 5 Drawing Sheets

SLEEPING SYSTEM

CROSS REFERENCE TO RELATED PATENT APPLICATIONS

This application claims priority of Chinese Patent Application No. 201921431819.8, entitled A GOLD ZERO PRESSURE INTELLIGENT SLEEP SYSTEM filed on Aug. 30, 2019, the entire contents of which are incorporated by reference herein.

FIELD OF THE INVENTION

The subject matter herein generally relates to a sleeping system, and particularly relates to a sleeping system in better adaption to a human body.

BACKGROUND OF THE INVENTION

In general, a sleeping system can include a mattress. A spring mattress is a kind of mattress which is commonly used in modern times and has better performance. A spring mattress generally includes a cushion with at least one spring installed inside. The cushion has the advantages of good elasticity, good supporting performance, strong air permeability and durability.

The spring inside the mattress can be a whole spring or can be a combination of a plurality of independent springs. The whole spring has large bearing capacity, but with uneven stress and poor sleeping experience. Each of the plurality of independent springs works independently and does not interference with each other, therefore providing a comfortable sleep experience.

SUMMARY OF THE INVENTION

The present disclosure provides a sleeping system. The sleeping system includes: a comfortable layer comprising a plurality of pressure relief springs; and a supporting layer arranged under the comfortable layer. The supporting layer includes a plurality of supporting springs corresponding to the plurality of pressure relief springs, each of the plurality of supporting springs is connected with one of the plurality of pressure relief springs to constitute a pair of spring, the plurality of supporting springs and the plurality of supporting springs forms a plurality of pairs of springs arranged along a length direction and a width direction of the sleeping system, each pair of spring has a same size, and a ratio of a length of the supporting spring to a length of the pressure relief spring in each pair of spring varies smoothly along the length direction of the sleeping system, thus a smooth curve formed at a joint between the comfortable layer and the supporting layer along the length direction of the sleeping system.

In at least one embodiment, each pair of spring is packaged in an independent bag.

In at least one embodiment, the bag is made of non-woven fabric or woven fabric.

In at least one embodiment, two adjacent bags are connected with hot melt adhesive.

In at least one embodiment, a difference of the length of two adjacent pressure relief springs is less than 2 cm.

In at least one embodiment, the sleeping system is divided into multiple sections along the length direction thereof, the ratio of the supporting spring to the pressure relief spring in two adjacent sections is different.

In at least one embodiment, the sleeping system is divided into multiple sections along the length direction thereof according to different pressure of different parts of a human body applied on the sleeping system.

In at least one embodiment, the multiple sections includes a first section 10 corresponding to a head part of the human body, a second section 11 corresponding to a shoulder part of the human body, a third section 12 corresponding to a back part of the human body, a fourth section 13 corresponding to a waist part of the human body, a fifth section 14 corresponding to a haunch part of the human body, a sixth section 15 corresponding to a thigh part of the human body, a seventh section 16 corresponding to a knee part of the human body, an eighth section 17 shank part of the human body, and a nineth section 18 corresponding to an ankle part of the human body.

In at least one embodiment, a length of each section along a length direction of the sleeping system is determined according to a height of a human body.

In at least one embodiment, the ration of the length of the pressure relief spring to the length of the supporting spring is 11:16 in a center of the first section, in a center of the fourth section and in a center of the eighth section.

In at least one embodiment, the ration of the length of the pressure relief spring to the length of the supporting spring is 7.5:19.5 in a center of the first section, and/or the ration of the length of the pressure relief spring to the length of the supporting spring is 9.5:17.5 in a center of the first section.

In at least one embodiment, the ration of the length of the pressure relief spring to the length of the supporting spring is 14:13 in a center of the fifth section; and/or the ration of the length of the pressure relief spring to the length of the supporting spring is 8.5:18.5 in a center of the sixth section, and/or the ration of the length of the pressure relief spring to the length of the supporting spring is 8:19 in a center of the seventh section, and/or the ration of the length of the pressure relief spring to the length of the supporting spring is 12:15 in a center of the ninth section.

In at least one embodiment, a wire diameter of the pressure relief spring 5 is less than a wire diameter of the supporting spring 6.

In at least one embodiment, the wire diameter of the supporting spring 6 is 1.8 mm-2.3 mm.

In at least one embodiment, the wire diameter of the pressure relief spring 5 is 1.1 mm-1.8 mm.

In at least one embodiment, the sleeping system further comprises a bottom layer arranged under the supporting layer.

In at least one embodiment, the sleeping system further comprises two supporting members arranged at two opposite sides thereof, and the comfortable layer and the supporting layer are arranged between the two supporting members.

In at least one embodiment, the sleeping system further comprises a skin-friendly layer on the comfortable layer.

In at least one embodiment, the supporting spring and the pressure relief spring in each pair of spring is integrally formed.

In at least one embodiment, either the supporting spring and the pressure relief spring are is a shape of barrel which is small on both sides and large in the center.

The sleeping system in the present disclosure includes an upper layer (comfortable layer) and a lower layer (supporting layer) and adjusts a ratio of pressure relief spring to the supporting spring according to the ergonomics and the pressure of different parts of a human body. When a human sleep on the sleeping system, the human body can be tightly wrapped, closely fitted, thus provide a perfect adaption to a human body. Accordingly, different downward pressure levels are generated during sleep, and precise release is carried out, which will not make people feel the discomfort, the blood is smooth, the five viscera and six viscera are dormant, and the body is in an extreme relaxation state so as to enter deep sleep, truly achieve zero excess, zero extrusion, zero gravity.

The sleeping system is divided into multiple sections corresponding to different parts of the human body, thus providing different support to different parts of the human body. The weight of each part of the human body is reasonably distributed, and the appropriate support is adjusted.

Each pair of spring is packaged in an independent bag which can prevent the spring from moving around and protect spring from friction and noise.

BRIEF DESCRIPTION OF THE DRAWINGS

Implementations of the present disclosure will now be described, by way of embodiment, with reference to the attached figures.

DETAILED DESCRIPTION OF THE PREFERRED EMBODIMENT

Figure 1:
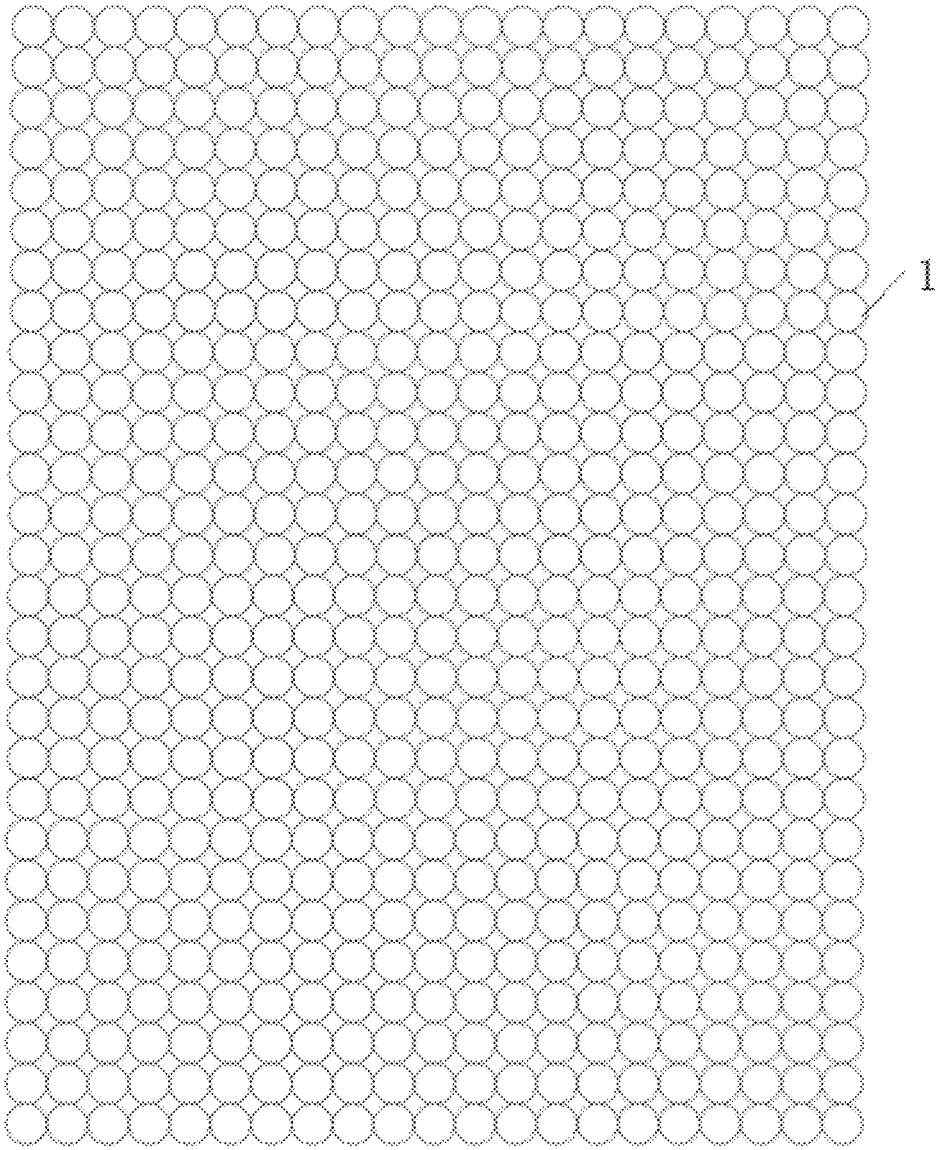
FIG. 1 is a plan view of a sleeping system according to an embodiment of the present disclosure.
Figure 2:
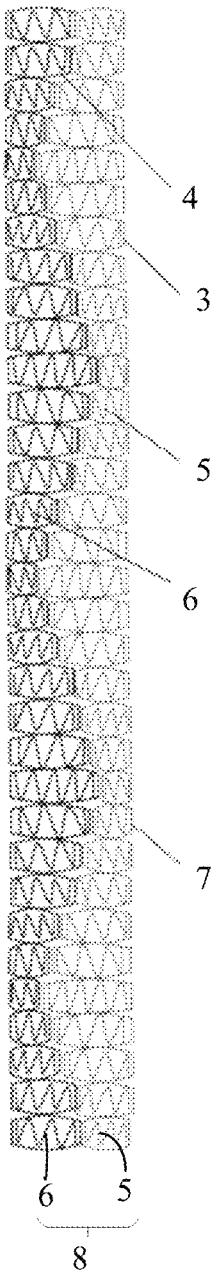
FIG. 2 is a cross-section diagram of the sleeping system according to an embodiment of the present disclosure, the sleeping system includes a supporting layer and a comfortable layer.
Figure 3:
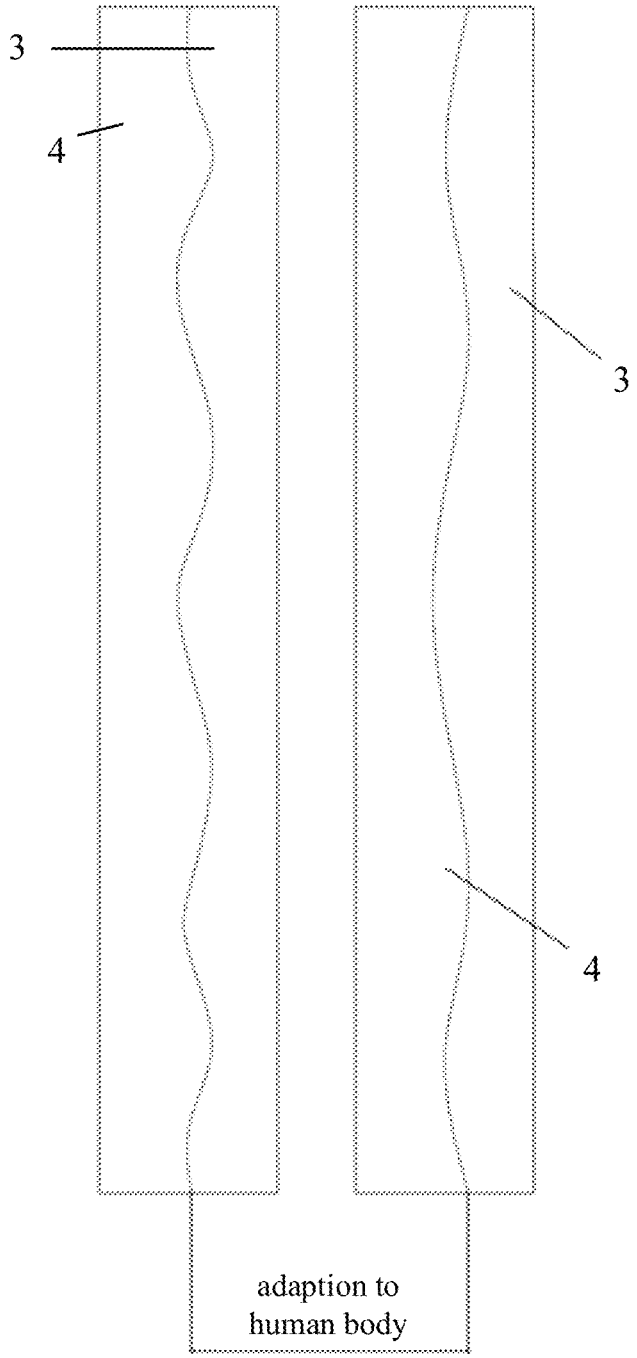
FIG. 3 illustrate the supporting layer and the comfortable layer varying in adaption with a human body according to an embodiment of the present disclosure.
Figure 4:
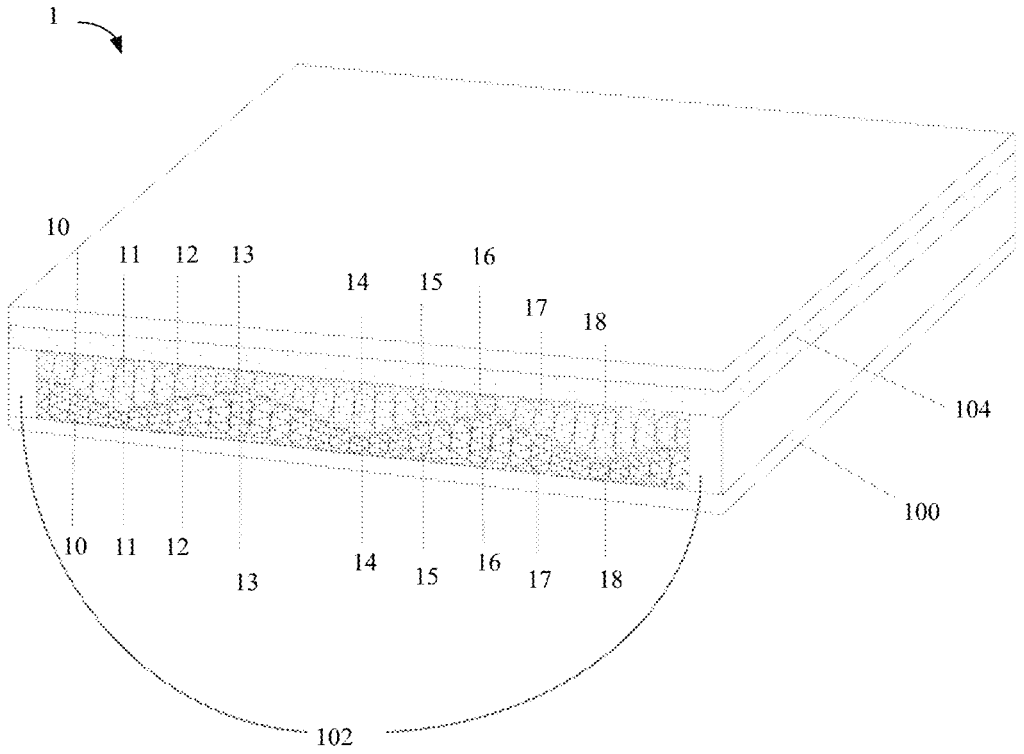
FIG. 4 is a cross-section diagram of the sleeping system according to another embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the invention, "multiple" means two or more, unless otherwise specifically defined.

The terms "center", "length", "width", "top", "bottom", and other indicating directions or positions are based on the directions or positions shown in the attached drawings in order to facilitate the description of the embodiment and simplify the description of the invention, rather than indicating or implying that the device or element referred to must have a specific orientation, be constructed and operated in a specific orientation, it cannot be understood as a limitation of the embodiment of the invention.

Referring to FIGS. 1-4, an embodiment of the present disclosure provides a sleeping system 1. In at least one embodiment, the sleeping system 1 can be a spring mattress. The sleeping system 1 can include a supporting layer 4 and a comfortable layer 3 arranged on the supporting layer 4. The comfortable layer 3 includes a plurality of pressure relief springs 5 and the supporting layer 4 includes a plurality of supporting springs 6. Each of the plurality of supporting springs 6 is corresponding to one of the plurality of pressure relief springs 5. Each of the plurality of supporting springs is connected with one of the plurality of pressure relief springs to constitute a pair of spring 8, the plurality of supporting springs 5 and the plurality of supporting springs 6 forms a plurality of pairs of springs 8 arranged along a length direction and a width direction of the sleeping system 1. Each pair of spring 8 has a same size, and a ratio of a length of the supporting spring 5 to a length of the pressure relief spring 6 in each pair of spring 8 varies smoothly along the length direction of the sleeping system 1, thus a smooth curve formed at a joint between the comfortable layer and the supporting layer along the length direction of the sleeping system 1 (referring to FIGS. 2 and 3). Each pair of spring 8 is packaged in an independent bag 7. Each bag 7 is in a same size. That is, in each bag 7, the total length of the pressure relief spring 5 and the supporting spring 6 is same. In at least one embodiment, the total length of the pressure relief spring 5 and the supporting spring 6 can be 20 cm to 40 cm, for example, 25 cm, 27 cm, 28 cm, 29 cm, 30 cm, 31 cm, 32 cm, 33 cm, 34 cm, 35 cm, 36 cm, 37 cm, 38 cm, 39 cm. It is should be understand that, the total length of the pressure relief spring 5 and the supporting spring 6 can be determined according to different requirements.

The sleeping system 1 can be divided into a plurality of sections corresponding parts of a human body. For example, referring to FIG. 4, the plurality of sections can include a first section 10 corresponding to a head part of the human body, a second section 11 corresponding to a shoulder part of the human body, a third section 12 corresponding to a back part of the human body, a fourth section 13 corresponding to a waist part of the human body, a fifth section 14 corresponding to a haunch part of the human body, a sixth section 15 corresponding to a thigh part of the human body, a seventh section 16 corresponding to a knee part of the human body, an eighth section 17 corresponding to a shank part of the human body, and a ninth section corresponding to an ankle part of the human body. When a human lays on the sleeping system, pressure of different parts of the human body on the sleeping system 1 are different. In order to provide a more comfortable sleeping experience, a ratio of a length of one of the plurality of the pressure relief springs 5 to a length of a corresponding one of the plurality of the supporting springs 6 can be designed based on the pressure of corresponding parts of the human body on the sleeping system.

In at least one embodiment, in the center of the first section, the ration of the length of the pressure relief spring 5 to the length of the supporting spring 6 can be 11:16; in center of the second section, the ration of the length of the pressure relief spring 5 to the length of the supporting spring 6 can be 7.5:19.5; in the third section, the ration of the length of the pressure relief spring 5 to the length of the supporting spring 6 can be 9.5:17:5; in the fourth section, the ration of the length of the pressure relief spring 5 to the length of the supporting spring 6 can be 11:16; in the fifth section, the ration of the length of the pressure relief spring 5 to the length of the supporting spring 6 14:13; in the sixth section, the ration of the length of the pressure relief spring 5 to the length of the supporting spring 6 can be 8.5:18.5; in the seventh section, the ration of the length of the pressure relief spring 5 to the length of the supporting spring 6 can be 8:19, in the eighth section, the ration of the length of the pressure relief spring 5 to the length of the supporting spring 6 can be 11:16; and in the ninth section, the ration of the length of the pressure relief spring 5 to the length of the supporting spring 6 can be 12:15.

In at least one embodiment, in order to provide a more comfortable support to the human body, the ration of the length of the supporting spring 6 to the length of the pressure relief spring 5 can be varied gradually and smoothly. For example, for the first section to the second section, the ration of the length of the supporting spring 6 to the length of the pressure relief spring 5 can be varied from 11:16 to 7.5:19.5 gradually and smoothly. Therefore, a smooth curve is formed at a joint between the comfortable layer 3 and the supporting layer 4. In at least one embodiment, the difference of the length of two adjacent pressure relief springs 5 can be less 2 cm, thus keep the length of the pressure relief spring 5 varies smoothly.

In at least one embodiment, the sleeping system 1 can be divided into a plurality of sections according to a height of a human body. That is, a length of each section along a length direction of the sleeping system 1 can be determined according to a height of a human body. For example, if a person has relatively long legs, a length of sections corresponding to the leg part of the human body can be designed to be relatively long accordingly. Thus, the sleeping system 1 can be designed to Meet the needs of people of different heights. For example, the seeping system 1 can be designed for a human body with a height of 120 cm, 130 cm, 140 cm, 150 cm, 160 cm, 170 cm, 180 cm, 190 cm, or 200 cm.

In at least one embodiment, in order to provide a more comfortable sleeping experience, a wire diameter of the pressure relief spring 5 is less than that of the supporting spring 6. In at least one embodiment, the wire diameter of the pressure relief spring 5 can be 1.1 mm-1.8 mm, and the wire diameter of the pressure relief spring 6 can be 1.8 mm-2.3 mm.

Figure 5:
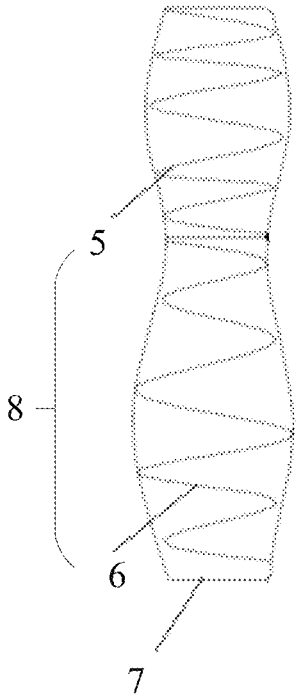
FIG. 5 is a schematic diagram of a spring according to an embodiment of the present disclosure.

Referring to FIG. 5, one of the plurality of pressure relief spring 5 and a corresponding supporting spring 6 is integrally formed. Such design can avoid the noise and spring dislocation due to a bonding structure under long-term friction. The pressure relief spring 5 and the supporting spring 6 are both in the shape of a barrel which is small on both sides and large in the center. Such design can reduce resistance and friction when the spring is forced to contract downward, thereby reducing noise and increasing service time. The one of the plurality of pressure relief spring 5 and a corresponding supporting spring 6 are packaged in an independent bag 7, which can prevent mildew due to damp and prevent invasion of flying. The bag 7 can be made of non-woven fabric which is durable and anti-worn and anti-tear and water-resistant. Adjacent bags 7 are interconnected with each other by hot welt adhesives so as to keep the bags 7 in place and not to move around. In at least one embodiment, the bag 7 can be made of woven material which is durable and anti-worn and anti-tear and water-resistant. The woven fabric can be single woven fabric including PP (polypropylene), PE (polyethylene) woven fabric, or compound woven fabric including PP and PE compound woven fabric, or PP and PET (polyethylene terephthalate) compound fabric.

Referring back to FIG. 4, in order to protect the sleeping system and provide a perfect support, the sleeping system 1 further includes a bottom layer 100 arranged under the supporting layer 4. The sleeping system 1 further includes two supporting members 102 arranged at two opposite sides of the sleeping system 1. The comfortable layer 3 and the supporting layer 4 are arranged between the two supporting members 102. Therefore, when a human sit on a side of the sleeping system, the two supporting members 102 can help to provide a stronger support. In order to provide skin friend experience, the sleeping system further includes a skin friendly layer 104 arranged on the comfortable layer 3 and the two supporting members 102.

The sleeping system of the present disclosure includes a comfortable layer 3 and a supporting layer 4 according to the ergonomics and the pressure of different parts of the human body, the spring in each independent bag 7 is divided into two portions: the lower portion is the support spring 6 (spring wire diameter is 1.8 mm-2.3 mm), the upper portion is the pressure relief spring 5 (buffer adaptation layer) (wire diameter is 1.1 mm-1.8 mm), the human body is tightly wrapped, comfortably fitted, the whole area is divided into a plurality of sections so as to provide different support and pressure relief to different parts of the human body, and the comfort layer spring and the support layer spring are integrally formed to avoid uneven supporting force, noise and other problems.

It is to be understood, even though information and advantages of the present exemplary embodiments have been set forth in the foregoing description, together with details of the structures and functions of the present exemplary embodiments, the disclosure is illustrative only. Changes may be made in detail, especially in matters of shape, size, and arrangement of parts within the principles of the present exemplary embodiments to the full extent indicated by the plain meaning of the terms in which the appended claims are expressed.

What is claimed is and desired to be protected by Letters Patent is:

1. A sleeping system, comprising:

a spring mattress having a predetermined width dimension extending from a first side to a second side, and a predetermined length dimension extending from a first head end to a second foot end;

a plurality of pressure relief springs comprising a first upper comfortable layer of said spring mattress;

a plurality of supporting springs corresponding in number to said plurality of pressure relief springs and comprising a second lower supporting layer of said spring mattress;

wherein each one of said plurality of supporting springs is connected with a corresponding one of said plurality of pressure relief springs so as together, said plurality of pressure relief springs and said plurality of supporting rings constitute a plurality of pairs of springs;

wherein said plurality of pairs of springs extend throughout said length dimension and said width dimension of said spring mattress and; and a ratio of a length of each one of said plurality of supporting springs to a length of each one of said plurality of pressure relief springs within each pair of springs varies smoothly along said length dimension of said spring mattress such that a smooth curve is formed at a dividing line defined between said first upper comfortable layer and second lower supporting layer along said length dimension of said spring mattress.

2. The sleeping system according to claim 1, wherein each pair of spring is packaged in an independent bag.

3. The sleeping system according to claim 2, wherein the bag is made of non-woven fabric or woven fabric.

4. The sleeping system according to claim 2, wherein two adjacent bags are connected with hot melt adhesive.

5. The sleeping system according to claim 1, wherein a difference of the length of two adjacent pressure relief springs is less than 2 cm.

6. The sleeping system according to claim 1, wherein the sleeping system is divided into multiple sections along the length direction thereof, the ratio of the supporting spring to the pressure relief spring in two adjacent sections is different.

7. The sleeping system according to claim 6, wherein the sleeping system is divided into multiple sections along the length direction thereof according to different pressure of different parts of a human body applied on the sleeping system.

8. The sleeping system according to claim 6, wherein the multiple sections includes a first section corresponding to a head part of the human body, a second section corresponding to a shoulder part of the human body, a third section corresponding to a back part of the human body, a fourth section corresponding to a waist part of the human body, a fifth section corresponding to a haunch part of the human body, a sixth section corresponding to a thigh part of the human body, a seventh section corresponding to a knee part of the human body, an eighth section corresponding to a shank part of the human body, and a ninth section corresponding to an ankle part of the human body.

9. The sleeping system according to claim 8, wherein a length of each section along a length direction of the sleeping system is determined according to a height of a human body.

10. The sleeping system according to claim 9, wherein the ration of the length of the pressure relief spring to the length of the supporting spring is 11:16 in a center of the first section, in a center of the fourth section and in a center of the eighth section.

11. The sleeping system according to claim 10, wherein the ration of the length of the pressure relief spring to the length of the supporting spring is 7.5:19.5 in a center of the first section, and/or the ration of the length of the pressure relief spring to the length of the supporting spring is 9.5:17.5 in a center of the first section.

12. The sleeping system according to claim 11, wherein the ration of the length of the pressure relief spring to the length of the supporting spring is 14:13 in a center of the fifth section; and/or the ration of the length of the pressure relief spring to the length of the supporting spring is 8.5:18.5 in a center of the sixth section, and/or the ration of the length of the pressure relief spring to the length of the supporting spring is 8:19 in a center of the seventh section, and/or the ration of the length of the pressure relief spring to the length of the supporting spring is 12:15 in a center of the ninth section.

13. The sleeping system according to claim 1, wherein a wire diameter of the pressure relief spring is less than a wire diameter of the supporting spring.

14. The sleeping system according to claim 13, wherein the wire diameter of the pressure relief spring is 1.8 mm-2.3 mm.

15. The sleeping system according to claim 13, wherein the wire diameter of the pressure relief spring is 1.1 mm-1.8 mm.

16. The sleeping system according to claim 1, wherein the supporting spring and the pressure relief spring in each pair of spring is integrally formed together.

17. The sleeping system according to claim 1, wherein either the supporting spring and the pressure relief spring are is a shape of barrel which is small on both sides and large in the center.

18. A sleeping system, comprising:

a spring mattress having a predetermined width dimension extending from a first side to a second side, and a predetermined length dimension extending from a first head end to a second foot end;

a plurality of pressure relief springs comprising a first upper comfortable layer of said spring mattress;

a plurality of supporting springs corresponding in number to said plurality of pressure relief springs and comprising a second lower supporting layer of said spring mattress;

wherein each one of said plurality of supporting springs is connected with a corresponding one of said plurality of pressure relief springs so as together, said plurality of pressure relief springs and said plurality of supporting rings constitute a plurality of pairs of springs;

a ratio of a length of each one of said plurality of supporting springs to a length of each one of said plurality of pressure relief springs within each pair of springs varies smoothly along said length dimension of said spring mattress such that a smooth curve is formed at a dividing line defined between said first upper comfortable layer and second lower supporting layer along said length dimension of said spring mattress;

a bottom platform disposed beneath said plurality of supporting springs comprising said second lower supporting layer of said spring mattress; and a pair of supporting members disposed upon opposite sides of said spring mattress such that when a human sits atop said spring mattress, said pair of supporting members add additional support to said spring mattress as a result of said spring mattress effectively being confined between said bottom platform and said pair of supporting members.

* * * * *